US010064495B2

(12) United States Patent
Tang

(10) Patent No.: US 10,064,495 B2
(45) Date of Patent: Sep. 4, 2018

(54) MULTIFUNCTIONAL FOLDING BENCH

(71) Applicant: WUXI HOUSETEX INDUSTRIES CO., LTD., Wuxi (CN)

(72) Inventor: Hongyan Tang, Wuxi (CN)

(73) Assignee: WUXI HOUSETEX INDUSTRIES CO., LTD, Wuxi (CN)

( * ) Notice: Subject to any disclaimer, the term of this patent is extended or adjusted under 35 U.S.C. 154(b) by 1 day.

(21) Appl. No.: 15/395,632

(22) Filed: Dec. 30, 2016

(65) Prior Publication Data

US 2017/0105535 A1 Apr. 20, 2017

Related U.S. Application Data

(63) Continuation of application No. PCT/CN2015/076670, filed on Apr. 15, 2015.

(30) Foreign Application Priority Data

Dec. 12, 2014 (CN) ..... 2014 1 0760362

(51) Int. Cl.
*A47C 7/62* (2006.01)
*A47C 4/02* (2006.01)
*B65D 25/04* (2006.01)

(52) U.S. Cl.
CPC ..... *A47C 7/62* (2013.01); *A47C 4/02* (2013.01); *A47C 4/021* (2013.01); *B65D 25/04* (2013.01)

(58) Field of Classification Search
CPC ..... A47C 7/62; A47C 5/005; A47C 4/021; A47C 4/02; A47B 2220/0083
USPC ..... 297/188.08, 440.1, 440.13; 108/165, 108/180, 157.14, 157.16, 157.15, 157.18
See application file for complete search history.

(56) References Cited

U.S. PATENT DOCUMENTS 1,776,071 A * 9/1930 Horwath ..... A47F 5/112 108/157.14
2,174,679 A * 10/1939 Zinser ..... A47B 3/12 108/157.14
2,801,145 A * 7/1957 Jones ..... A47B 47/06 312/259
2,895,541 A * 7/1959 Spivack ..... A47C 5/005 220/560.15
3,069,216 A * 12/1962 Vaeth ..... A47B 47/042 108/158.12
3,807,823 A * 4/1974 Rouse ..... A47B 17/00 108/157.14

(Continued)

*Primary Examiner* — Jose V Chen
(74) *Attorney, Agent, or Firm* — Wayne & King LLC

(57) ABSTRACT

Disclosed is a multifunctional folding bench, comprising a foldable bench seat and a bench cap connected to the bench seat, wherein at least one main baffle plate is mounted in the bench seat and is in an inserted connection with a plurality of auxiliary baffle plates, and due to the inserted connection of the main baffle plates and the auxiliary baffle plates, a plurality of storing cavities are separated in the bench seat. The folding bench realizes the separation of the internal space of the bench seat by the inserted connection of the main baffle plates and the auxiliary baffle plates, and male connection of the buckles and female connection buckle are used so that the connections between the main baffle plate, the auxiliary baffle plates and the bench seat are fixing and reliable, and the positioning is accurate. The folding bench is simple in structure, is convenient to use, to carry and store, and has a storing function.

5 Claims, 8 Drawing Sheets

(56) References Cited

U.S. PATENT DOCUMENTS

| | | | | | |
|---|---|---|---|---|---|
| 3,837,719 | A * | 9/1974 | Barron | A47B 3/00 | 108/115 |
| 3,871,726 | A * | 3/1975 | Stegner | A47B 3/00 | 108/157.14 |
| 4,138,951 | A * | 2/1979 | Nelson | A47B 3/00 | 108/115 |
| 4,333,622 | A * | 6/1982 | Albano | A47B 65/00 | 108/165 |
| 4,569,564 | A * | 2/1986 | Ahmann | A47B 23/044 | 108/34 |
| 4,750,402 | A * | 6/1988 | Markey | G10G 7/005 | 108/90 |
| 5,402,738 | A * | 4/1995 | Carr | A47F 5/10 | 108/157.1 |
| 6,267,065 | B1 * | 7/2001 | Lin | A47B 13/003 | 108/157.14 |
| 7,798,075 | B2 * | 9/2010 | Bettinger | A47B 13/02 | 108/157.12 |
| 8,079,315 | B2 * | 12/2011 | Berent | A47B 3/06 | 108/157.14 |
| 8,458,980 | B2 * | 6/2013 | Ivanov | A63H 33/084 | 446/105 |
| 2006/0267393 | A1 * | 11/2006 | Benites | A47C 3/16 | 297/440.14 |
| 2008/0157582 | A1 * | 7/2008 | Bertele | A47B 43/02 | 297/440.12 |
| 2009/0251034 | A1 * | 10/2009 | Nielsen | A47B 43/02 | 312/259 |
| 2012/0074823 | A1 * | 3/2012 | Bezich | A47B 87/0292 | 312/240 |

* cited by examiner

MULTIFUNCTIONAL FOLDING BENCH

CROSS-REFERENCE TO RELATED APPLICATIONS

This application is a continuation of International Patent Application No. PCT/CN2015/075670 with a filing date of Apr. 15, 2015, designating the United States, now pending, and further claims priority to Chinese Patent Application No. 201410760362.0 with a filing date of Dec. 12, 2014. The content of the aforementioned application, including any intervening amendments thereto, are incorporated herein by reference.

TECHNICAL FIELD

The present invention relates to a bench, and in particular to a multifunctional folding bench.

BACKGROUND OF THE PRESENT INVENTION

At present, in the field of household benches, most of the existing benches cannot be folded. A very few of the existing foldable benches are formed in a way that bench surfaces and bench legs are connected with each other by hinges, but the foldable benches are still large in volume after being folded and particularly occupy large area in height and length directions. Therefore, the existing foldable benches are not suitable for being used, carried and stored in families with small household space. Meanwhile, the existing foldable benches do not have a storing function, so cannot meet the demand of family storage.

SUMMARY OF PRESENT INVENTION

For the defects in the above-mentioned existing production, the applicant provides a multifunctional folding bench; after being folded, the multifunctional folding bench has small volume, is convenient to carry and store, not only has small occupied area, but also has a storing function.

Solution of the Problems

Technical Solution

The technical solution adopted by the present invention is described as follows:

The multifunctional folding bench comprises a foldable bench seat; the bench seat is connected with a bench cap; at least one main baffle plate is mounted in the bench seat and is in inserted connection with a plurality of auxiliary baffle plates; and the interior of the bench seat is separated into a plurality of storing cavities by the inserted connection of the main baffle plate(s) and the auxiliary baffle plates.

Further, the technical solution is as follows:

The bench seat is formed in a way that a plurality of bench walls are connected with each other to form a four-side barrel body, one end of the four-side barrel body is provided with a soft closure, first female connection buckles and a plurality of second female connection buckles are arranged at the periphery of the inner wall of the four-side barrel body, and the first female connection buckles and the second female connection buckles are made of fine soft fiber materials.

All the first female connection buckles are connected with each other to form a quadrangle and are arranged on the inner wall of the four-side barrel body transversally, and the second female connection buckles are longitudinally arranged on the inner wall of the four-side barrel body.

The main baffle plate(s) is/are transversely arranged in the bench seat, each main baffle plate is a rectangular plate and consists of a hard plate and a soft surface layer wrapped on the hard plate, a first male connection buckle and a second male connection buckle are respectively arranged at the corners at the two ends of each main baffle plate and are made of echinated materials with hooks, a plurality of first slots are formed in each main baffle plate, and the first slots occupy ⅔ of the total length of each main baffle plate.

The auxiliary baffle plates are longitudinally arranged in the bench seat, each auxiliary baffle plate is also a rectangular plate and consists of a hard plate and a soft surface layer wrapped on the hard plate, third male connection buckles are arranged at the two ends of each auxiliary baffle plate, a second slot is formed at the center of each auxiliary baffle plate, and each second slot occupies ⅔ of the total length of each auxiliary baffle plate.

The multifunctional folding bench further comprises a bottom plate, wherein the bottom plate is mounted in the bench seat and is abutted against the soft closure, the bottom plate consists of a hard plate and a soft surface layer wrapped on the hard plate and is rectangular, and one end of the bottom plate is also provided with a pull ring.

The bench cap is a quadrilateral box body, and a sponge layer is arranged in the bench cap.

Folding lines are arranged on at least one group of symmetrical bench walls, and each folding line is arranged at the ⅓ location of the total length of each bench wall.

The bench seat is the four-side barrel body when in an unfolded state, and the bench seat is in a 'Z' shape when in a folded state.

Beneficial Effects of the Invention:

Beneficial Effects

The present invention has the following beneficial effects:

The multifunctional folding bench is simple in structure and is convenient to use; the separation of the internal space of the bench seat is effectively realized by the inserted connection of the main baffle plate(s) and the auxiliary baffle plates; the main baffle plate(s), the auxiliary baffle plates and the bench seat are connected with each other fixedly and reliably by the connection of the male connection buckles and the female connection buckles, and the folding bench is positioned accurately; and the multifunctional folding bench has dual functions of a seat and a shoe cabinet, wide use scope and stall volume after being folded is convenient to carry and store, and not only has small occupied area, but also has a storing function.

Wherein 1, Bench cap; 2, Bench seat; 201, First female connection buckle; 202, Second female connection buckle; 203, Bench wall; 204, Soft closure; 205, folding line; 3, main baffle plate; 301, first male connection buckle; 302, second male connection buckle; 303, first slot; 4, auxiliary baffle plate; 401, third male connection buckle; 402, second slot; 5, bottom plate; 501 pull ring.

DETAILED DESCRIPTION OF PREFERRED EMBODIMENTS

A specific implementation manner of the present invention is described below in combination with the drawings.

Figure 1:
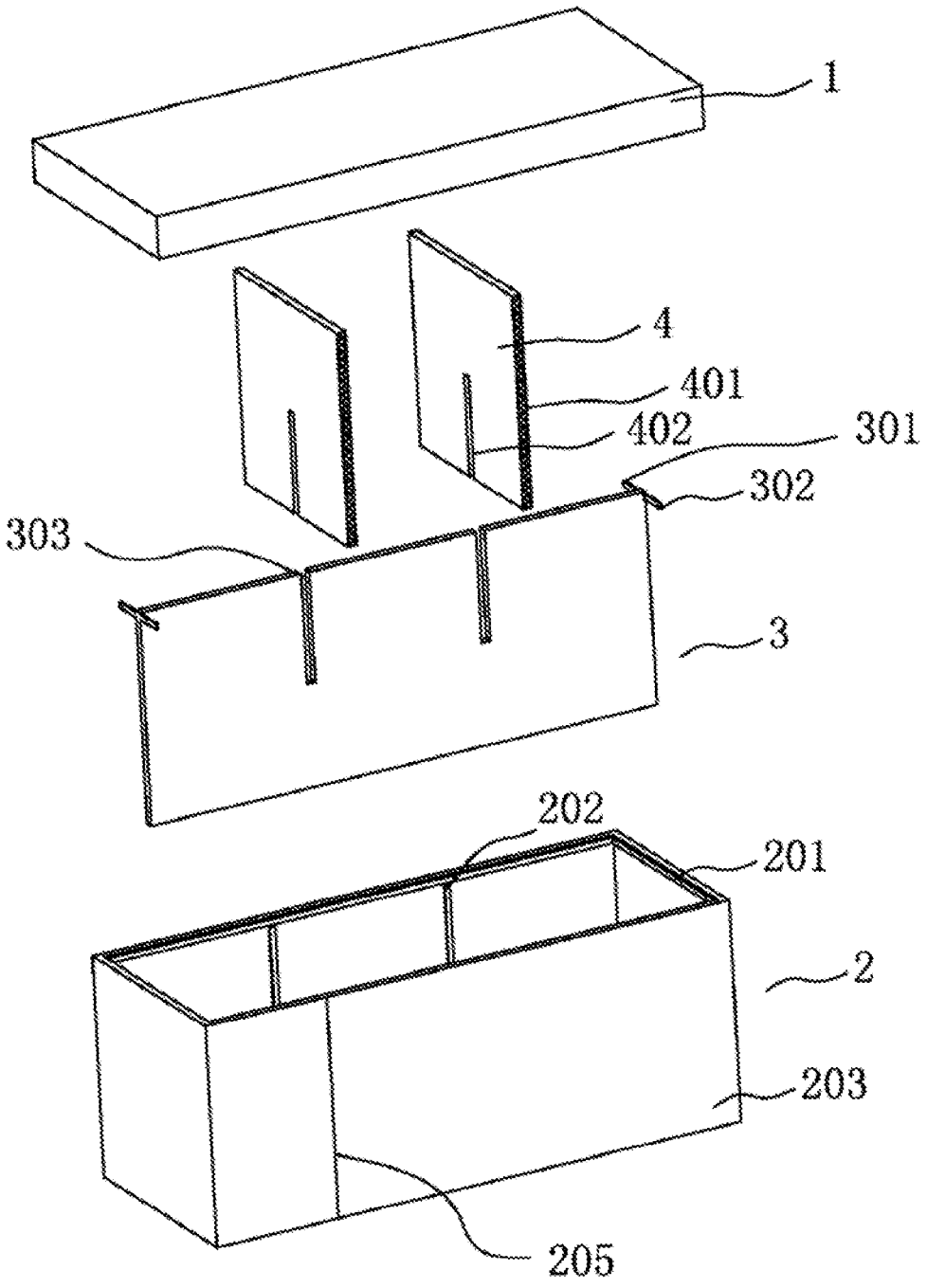
FIG. 1 is an exploded view of the present invention.

As shown in FIG. 1, a multifunctional folding bench comprises a foldable bench seat 2, the bench seat 2 is connected with a bench cap 1, the bench cap 1 is a quadrilateral box body, and a sponge layer is arranged in the bench cap 1. At least one main baffle plate 3 is mounted in the bench seat 2 and is in inserted connection with a plurality of auxiliary baffle plates 4, and the interior of the bench seat 2 is separated into a plurality of storing cavities by the inserted connection of the main baffle plate(s) 3 and the auxiliary baffle plates 4.

Figure 2:
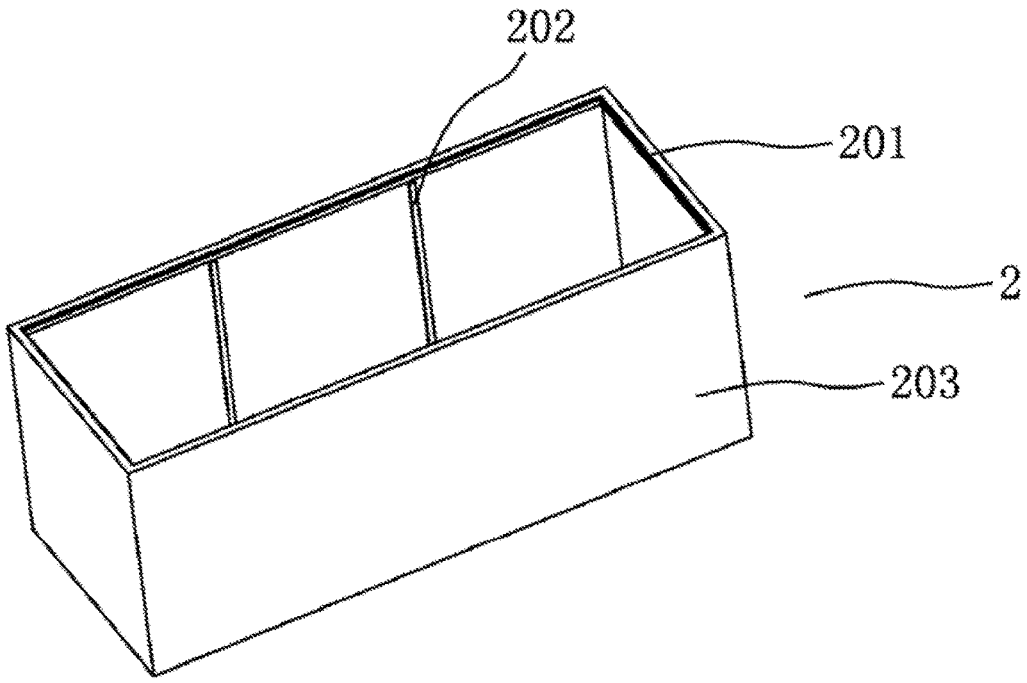
FIG. 2 is a structural schematic diagram of a bench seat in the present invention.
Figure 3:
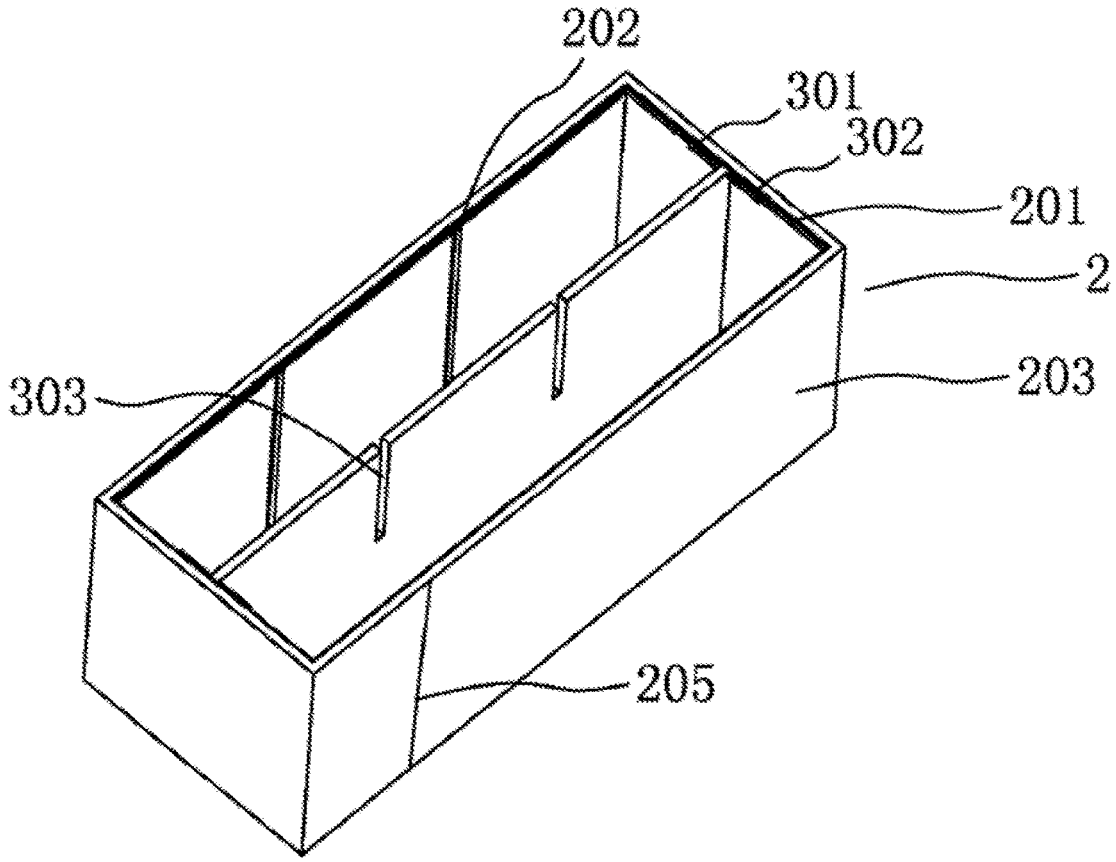
FIG. 3 is a structural schematic diagram of connection of a bench seat and a main baffle plate in the present invention.
Figure 4:
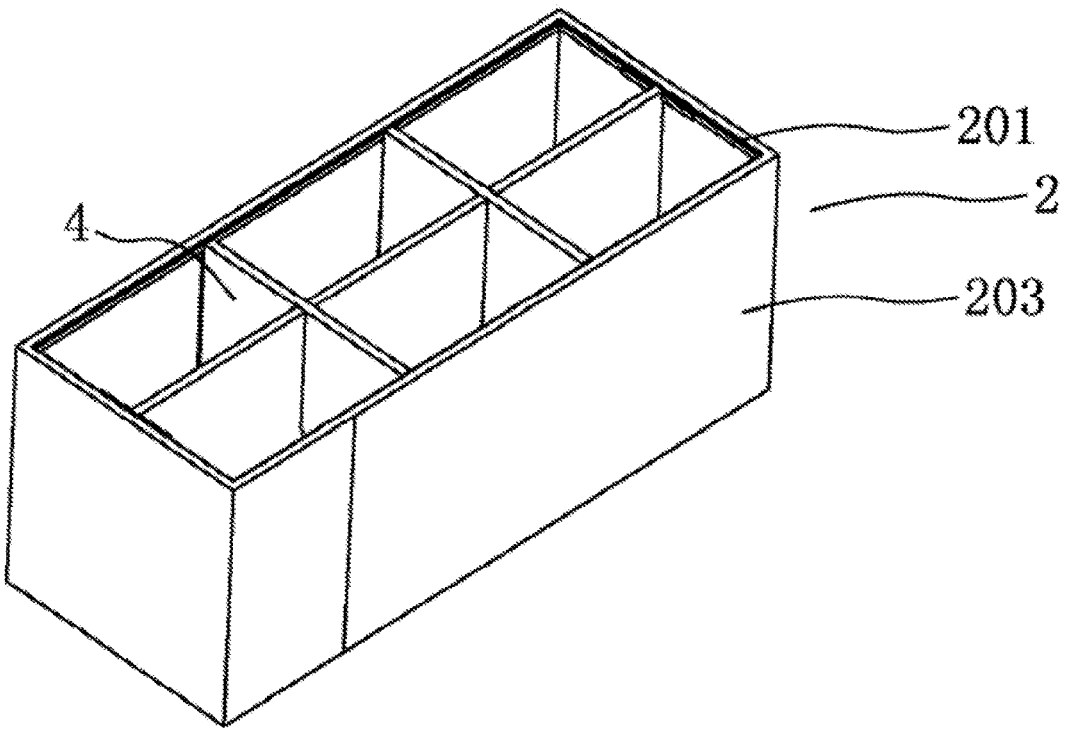
FIG. 4 is a structural schematic diagram of connection of a main baffle plate, auxiliary baffle plates and a bench seat in the present invention.

As shown in FIG. 2, FIG. 3 and FIG. 4, the bench seat 2 is formed in a way that a plurality of bench walls 203 are connected with each other to form a four-side barrel body, one end of the four-side barrel body is provided with a soft closure 204, first female connection buckles 201 and a plurality of female connection buckles 202 are arranged at the periphery of the inner wall of the four-side barrel body, and the first female connection buckles 201 and the female connection buckles 202 are made of fine soft fiber materials. All the first female connection buckles 201 are connected with each other to form a quadrangle and are arranged on the inner wall of the four-side barrel body transversally, and the second female connection buckles 202 are longitudinally arranged on the inner wall of the four-side barrel body. Folding lines 205 are arranged on at least one group of symmetrical bench walls 203, and each folding line 205 is arranged at the ⅓ location of the total length of each bench wall 203. The bench seat 2 is the four-side barrel body when in an unfolded state, and the bench seat 2 is in a 'Z' shape when in a folded state.

As shown in FIG. 2, FIG. 3 and FIG. 4, the main baffle plate(s) 3 is/are transversely arranged in the bench seat 2, each main baffle plate 3 is a rectangular plate and consists of a hard plate and a soft surface layer wrapped on the hard plate, a first male connection buckle 301 and a second male connection buckle 302 are respectively arranged at the corners at the two ends of each main baffle plate 3 and are made of echinated materials with hooks, a plurality of first slots 303 are formed in each main baffle plate 3, and the first slots occupy ⅔ of the total length of each main baffle plate 3. The auxiliary baffle plates 4 are longitudinally arranged in the bench seat 2, each auxiliary baffle plate 4 is also a rectangular plate and consists of a hard plate and a soft surface layer wrapped on the hard plate, third male connection buckles 401 are arranged at the two ends of each auxiliary baffle plate 4, a second slot 402 is also formed at the center of each auxiliary baffle plate 4, and each second slot 402 occupies ⅔ of the total length of each auxiliary baffle plate 4.

Figure 8:
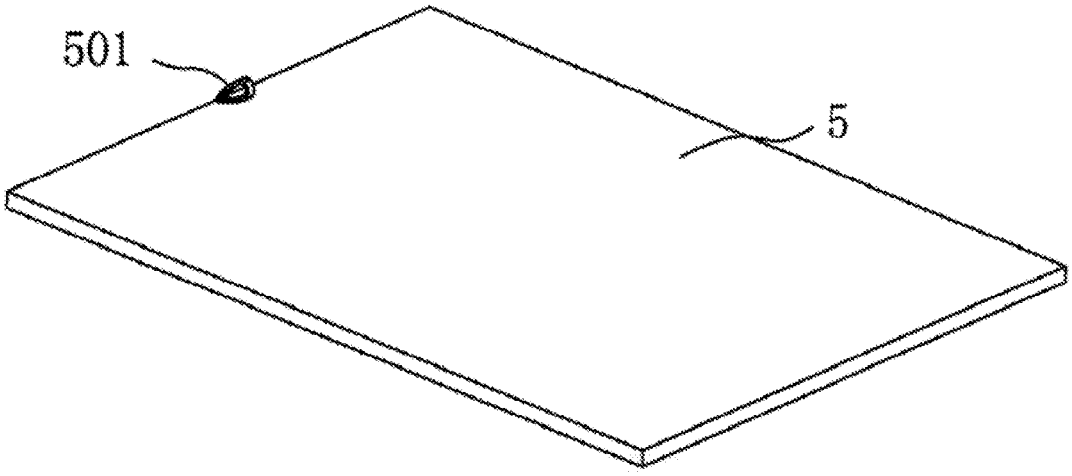
FIG. 8 is a structural schematic diagram of a bottom plate in the present invention.

As shown in FIG. 8, the multifunctional folding bench further comprises a bottom plate 5, wherein the bottom plate 5 is mounted in the bench seat 2 and is abutted against the soft closure 204, the bottom plate 5 also consists of a hard plate and a soft surface layer wrapped on the hard plate and is rectangular, and one end of the bottom plate 5 is also provided with a pull 501.

Figure 5:
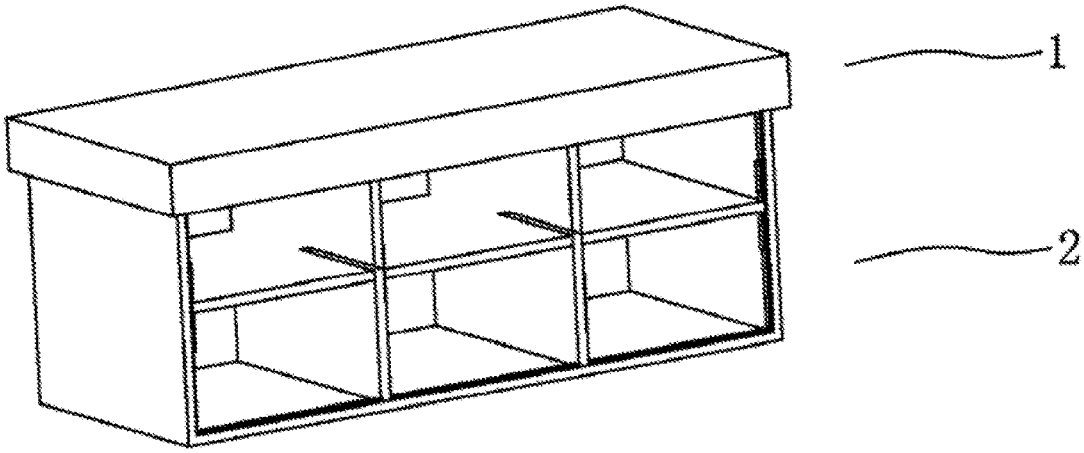
FIG. 5 is a schematic diagram I of a working state of the present invention.
Figure 6:
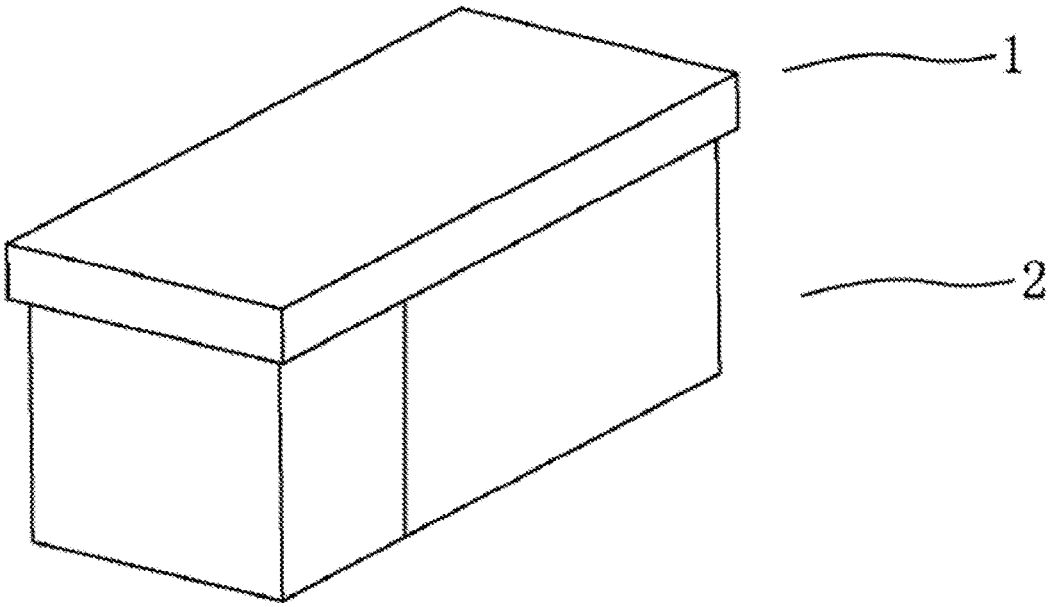
FIG. 6 is a schematic diagram II of a working state of the present invention.
Figure 7:
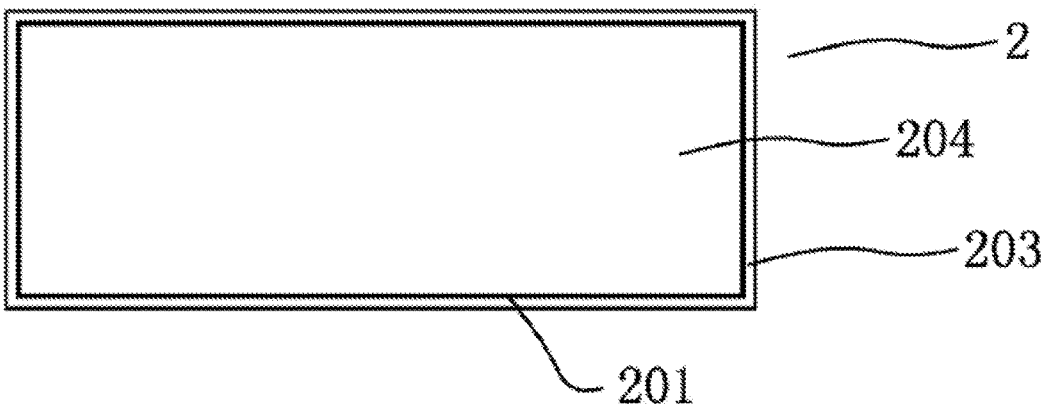
FIG. 7 is a top view of a bench seat in the present invention.

The specific working process of the present invention is described as follows:

As shown in FIG. 1-FIG. 4, firstly, the bench seat 2 is unfolded to form the four-side barrel body, then the bottom plate 5 is placed into the four-side barrel body, the bottom plate 5 is abutted against the soft closure 204 arranged at one end of the four-side barrel body, and the bottom plate 5 restricts the bench seat 2 to be folded, so that the bench seat 2 can keep an unfolded state. Then, one main baffle plate 3 is placed into the bench seat 2; the main baffle plate 3 is transversely arranged and located at the center of the bench seat 2 and the interior of the bench seat 2 is separated into two storing cavities with same volume; at this moment, the first male connection buckle 301 and the second male connection buckle 302 arranged at the corners at the two ends of the main baffle plate 3 are both adhered to the first female connection buckles 201 on the bench walls 203, then two auxiliary baffle plates 4 are in longitudinal inserted connection with the main baffle plate 3 by the second slots 402 and the first slots 303, the third male connection buckles 401 arranged at the two ends of each auxiliary baffle plate 4 are adhered and positioned with the second female connection buckles 202 on the bench walls 203, so that all the auxiliary baffle plates 4 are connected with the main baffle plate 3 to form a cross shape; meanwhile, the storing cavities with same volume are separated again into six storing cavities with same volume by the inserted connection of two auxiliary baffle plates 4 and the main baffle plate 3, and the storing cavities can store clothes, shoes and any other articles (the volume of the articles adapt to that of the storing cavities). Next, the bench cap 1 is covered on the bench seat 2 to realize a function of a seat. When the folding bench does not need to be used, the bench cap 1 is taken down, the main baffle plate 3 can be easily separated from the auxiliary baffle plates 4 by disconnection of the first male connection buckle 301, the second male connection buckle 302 and the first female connection buckles 201 and the disconnection of the third male connection buckles 401 and the second female connection buckles 202, and then the bottom plate 5 is taken out by the pull ring 501, so that the bench seat 2 is in a foldable state; and the bench seat 2 is folded along the folding lines 205 into a 'Z' shape and then can be in internal match with the bench cap 1, so that the folded bench seat 2, the main baffle plate 3, the auxiliary baffle plates 4 and the bottom plate 5 can be stored in the bench cap 1. As shown in FIG. 5 and FIG. 6, when the bench seat 2 is placed laterally, all the storing cavities are exposed; at this moment, the folding bench can be used as a shoe cabinet; and the folding bench can be used as the seat when the bench seat 2 is placed frontally.

I claim:

1. A multifunctional folding bench, comprising a bench cap (1), a foldable bench seat (2), connected with the bench cap (1) and a bottom plate (5); wherein at least one main baffle plate (3) is mounted in the bench seat (2) and is in inserted connection with a plurality of auxiliary baffle plates (4), and the interior of the bench seat (2) is separated into a plurality of storing cavities by the inserted connection of the main baffle plate(s) (3) and the auxiliary baffle plates (4);

wherein the bench seat (2) is formed in a way that a plurality of bench walls (203) are connected with each other to form a four-side barrel body, one end of the four-side barrel body is provided with a soft closure (204), a plurality of first female connection elements (201) are transversally arranged on the inner wall of the four-side barrel body to form a quadrangle, and a plurality of second female connection elements (202) are longitudinally arranged on the inner wall of the four-side barrel body;

wherein the bottom plate (5) is mounted in the bench seat (2) and is abutted against the soft closure (204), and one end of the bottom plate (5) is provided with a pull ring (501);

wherein first male connection elements (301) and second male connection elements (302) are respectively arranged at the corners at the two ends of each main baffle plate (3), and the first and second male connection elements (301, 302) are adhered to the first male connection elements (201); and wherein third male connection elements (401) are arranged at the two ends of each auxiliary baffle plate (4), and the third male connection elements (401) are adhered to the second male connection elements (202).

2. The multifunctional folding bench according to claim 1, wherein the first female connection elements (201) and the second female connection elements (202) are made of fine soft fiber materials.

3. The multifunctional folding bench according to claim 2, wherein folding lines (205) are arranged on at least one group of symmetrical bench walls (203), and each folding line (205) is arranged at the ⅓ location of the total length of each bench wall (203).

4. The multifunctional folding bench according to claim 1, wherein the main baffle plate(s) (3) is/are transversely arranged in the bench seat (2), each main baffle plate (3) is a rectangular plate the first male connection buckle (301) and the second male connection buckle (302) are made of echinated materials with hooks, a plurality of first slots (303) are formed in each rain baffle plate and the first shots (303) occupy ⅔ of the total length of each main baffle plate (3).

5. The multifunctional folding bench according to claim 1, wherein the auxiliary baffle plates (4) are longitudinally arranged in the bench seat (2), each auxiliary baffle plate (4) is also a rectangular plate, a second slot (402) is formed at the center of each auxiliary baffle plate (4), and each second slot (402) occupies ⅔ of the total length of each auxiliary baffle plate (4).

* * * * *